US008342630B2

(12) United States Patent
Uchida et al.

(10) Patent No.: US 8,342,630 B2
(45) Date of Patent: Jan. 1, 2013

(54) RECORDING APPARATUS AND RECORDING POSITION ADJUSTMENT METHOD

(75) Inventors: Naoki Uchida, Kawasaki (JP); Keita Tamiya, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 242 days.

(21) Appl. No.: 12/720,545

(22) Filed: Mar. 9, 2010

(65) Prior Publication Data

US 2010/0238221 A1 Sep. 23, 2010

(30) Foreign Application Priority Data

Mar. 19, 2009 (JP) ..... 2009-067908

(51) Int. Cl.
*B41J 29/38* (2006.01)
*B41J 2/15* (2006.01)

(52) U.S. Cl. ..... 347/14; 347/19; 347/40

(58) Field of Classification Search ..... None
See application file for complete search history.

(56) References Cited

U.S. PATENT DOCUMENTS 6,471,315 B1 10/2002 Kurata
6,491,373 B1 * 12/2002 Fujita et al. ..... 347/41
7,014,289 B1 * 3/2006 Matsuda ..... 347/19
2007/0291093 A1 * 12/2007 Izumi ..... 347/101

FOREIGN PATENT DOCUMENTS

JP 11-240146 A 9/1999
JP 2007-331315 A 12/2007

* cited by examiner

*Primary Examiner* — Stephen Meier
*Assistant Examiner* — Alexander C Witkowski
(74) *Attorney, Agent, or Firm* — Canon USA, Inc., IP Division

(57) ABSTRACT

A recording apparatus for recording an image on a recording medium and causing a recording head to perform scanning in a scanning direction includes an acquisition unit configured to acquire a recording position deviation amount of the recording head in each of a plurality of positions in the scanning direction, an addition unit configured determine a corrected recording deviation amount by adding to the acquired recording position deviation amount, a correction amount that varies based on one raster or a number of rasters, and a recording unit configured to record the image with the recording head based on the corrected recording deviation amount.

5 Claims, 20 Drawing Sheets

RECORDING APPARATUS AND RECORDING POSITION ADJUSTMENT METHOD

BACKGROUND OF THE INVENTION

1. Field of the Invention

The present invention relates to a recording apparatus that performs recording by using a recording head for discharging ink, and a recording position adjustment method for the recording apparatus.

2. Description of the Related Art

In ink jet recording apparatuses, conventional methods for correcting deviation of an impact position or a dot-recorded position (ink droplet) on a recording medium are known. Japanese Patent Application Laid-Open No. 11-240146 discusses a technology that can accurately correct a recording position irrespective of the position in a scanning direction even when a distance between a carriage, having a recording head loaded thereon, and a recording medium changes in the scanning direction, by controlling ink discharge timing according to a scanning-direction position of the carriage.

When the ink discharge timing is controlled according to the scanning-direction position of the carriage, a dot can be recorded in a target recording position. However, a white streak or a black streak may be generated in the position of correcting the discharge timing.

FIGS. 20A to 20C illustrate generation of streaks when the ink discharge timing is controlled according to the scanning-direction position of the carriage by a conventional recording position adjustment method. FIG. 20A schematically illustrates a relationship between the scanning-direction position of the carriage and a recording position deviation amount. The vertical axis indicates a deviation amount with respect to a broken-line target recording position 42. As illustrated in FIG. 20A, the deviation amount of the recording position in the scanning direction continuously changes.

FIG. 20B illustrates, if the recording position deviation changes in the scanning direction as illustrated in FIG. 20A, a relationship between a recording position deviation amount and a discharge timing shift amount when the ink discharge timing shift amount is generated according to the recording position deviation amount. The discharge timing shift amount can be generated in units of one step of a carriage encoder. In FIG. 20B, the ink discharge timing is corrected to be earlier or later by one step than the current discharge timing.

When the discharge timing is corrected as described above, discontinuity occurs in shift amount of the recording position. FIG. 20C illustrates arrangements of dots 100 in the scanning direction when no recording position adjustment is performed in a plurality of positions in the scanning direction (C-1) and when recording position adjustment is performed (C-2). FIG. 20C illustrates target recording positions with broken lines 15, and recording positions are corrected at predetermined intervals in the scanning direction. When no recording position adjustment is performed in a plurality of positions in the scanning direction, the recording position deviation is corrected for a given target recording position 15 (left side in FIG. 20C), and a deviation amount between dots is very small in an adjacent area. However, the recording position deviation occurs in the case of the target recording position 15 at the right side in FIG. 20C.

On the other hand, when recording position adjustment is performed in a plurality of positions in the scanning direction, the recording position deviation is corrected for a plurality of target recording positions in the scanning direction. When such recording position adjustment is performed, dots can be recorded in positions close to the target recording positions in all recording positions. However, in a position (target recording position) where a shift amount changes, a change amount larger than a minute deviation amount from an adjacent dot is added, thus generating a streak in an image. In the illustrated example, a white streak 14 is generated, and black streaks may be generated depending on overlapping of dots.

SUMMARY OF THE INVENTION

The present invention is directed to a recording apparatus that can reduce deterioration of image quality accompanying the generation of streaks when the recording position deviation is corrected according to a position in a scanning direction of a carriage.

According to an aspect of the present invention, a recording apparatus for recording an image on a recording medium and causing a recording head to perform scanning in a scanning direction includes an acquisition unit configured to acquire a recording position deviation amount of the recording head in each of a plurality of positions in the scanning direction, an addition unit configured determine a corrected recording deviation amount by adding, to the acquired recording position deviation amount, a correction amount that varies based on one raster or a number of rasters, and a recording unit configured to record the image with the recording head based on the corrected recording deviation amount.

According to an exemplary embodiment of the present invention, deterioration of image quality accompanying the generation of streaks when the recording position deviation is corrected according to a position in the scanning direction of the carriage can be reduced.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
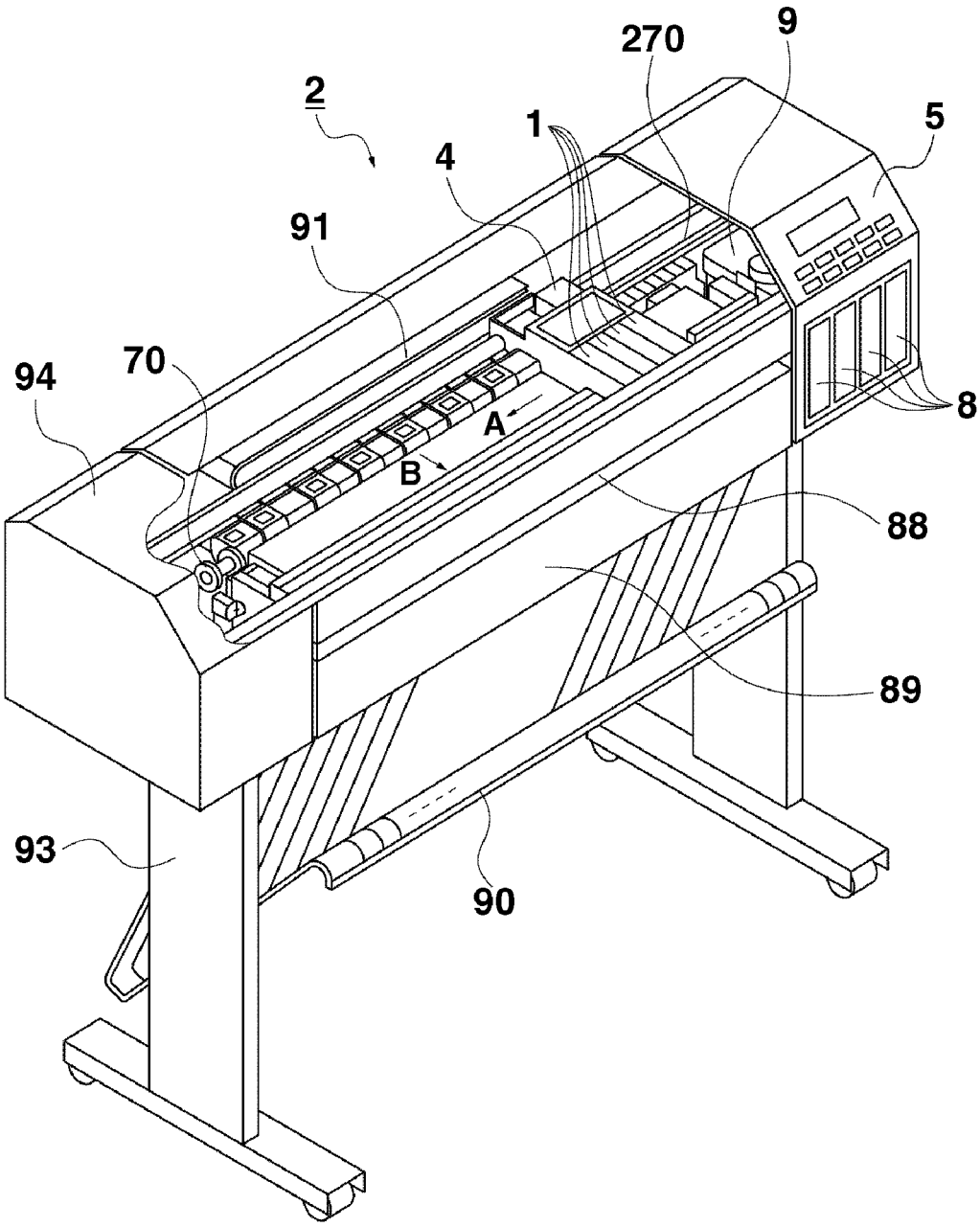
FIG. 1 is a perspective diagram illustrating a recording apparatus according to an exemplary embodiment of the present invention.

FIG. 1 is an appearance perspective diagram illustrating an ink jet recording apparatus according to an exemplary embodiment of the present invention. The ink jet recording apparatus (hereinafter, may be simply referred to as the recording apparatus) 2 includes manual-feed insertion ports 88 disposed on its front face, and a roll paper cassette 89 disposed in its lower portion to be openable/closable to the front. Recording media such as recording paper are fed from the manual-feed insertion ports 88 or the roll paper cassette 89 into the recording apparatus. The ink jet recording apparatus 2 includes an apparatus body 94 supported by two legs 93, a stacker 90 configured to stack discharged recording media, and a transparent openable/closable upper cover 91 that provides inner visibility. On the right side of the apparatus body 94, the inkjet recording apparatus 2 includes an operation panel 5, an ink supply unit, and an ink tank.

The recording apparatus 2 further includes a conveyance roller 70 configured to convey the recording media such as recording paper in an arrow direction B (sub-scanning direction), and a carriage unit (carriage) 4 guided and supported to perform reciprocal scanning in a width direction (arrow direction A, scanning direction) of the recording media. The recording apparatus 2 includes a carriage motor (not illustrated) and a carriage belt (hereinafter, referred to as the belt) 270 configured to reciprocate the carriage 4 in the arrow direction A, and a recording head 1 fixed to the carriage 4. The recording apparatus 2 includes a suction type ink recovery unit 9 configured to supply ink and eliminate an ink discharge failure caused by clogging of a discharge port of the recording head 1. A linear scale is disposed in the scanning direction. A relative moving distance of the carriage 4 is detected by counting output pulses of an encoder sensor (not illustrated), and ink discharge timing is controlled based on this information.

In the case of this recording apparatus, in order to perform color recording on the recording media, the recording head 1 including twelve heads corresponding to 12-color ink is fixed to the carriage 4. With this configuration, the conveyance roller 70 conveys the recording medium to a predetermined recording start position. Then, scanning of the recording head 1 in a main scanning direction by the carriage 4 and conveyance of the recording medium in the sub-scanning direction by the conveyance roller 70 are repeated to perform recording.

In other words, the carriage 4 is moved in the arrow direction A in FIG. 1 by the belt 270 and the carriage motor (not illustrated), thereby executing recording on the recording medium. When the carriage 4 is moved back to a position before the scanning (home position), the conveyance roller 70 conveys the recording medium in the sub-scanning direction (arrow direction B in FIG. 1). Then, the carriage 4 is driven to perform scanning again in the arrow direction A in FIG. 1, thereby recording an image or a character on the recording medium. When this operation is repeated, and recording on one recording medium is completed, the recording medium is discharged into the stacker 90 to complete recording on one recording medium.

The carriage 4 includes a reflection type optical sensor 30 (FIG. 3), which functions to detect a density of an adjustment pattern recorded on the recording medium (sheet) in order to detect deviation of a recording position. Combining the scanning of the carriage 4 in the scanning direction and the sheet conveyance operation in the sub-scanning direction enables the reflection type optical sensor 30 to detect the density of the adjustment pattern recorded on the sheet. The reflection type optical sensor 30 may be used for detecting an end of the sheet.

Figure 2:
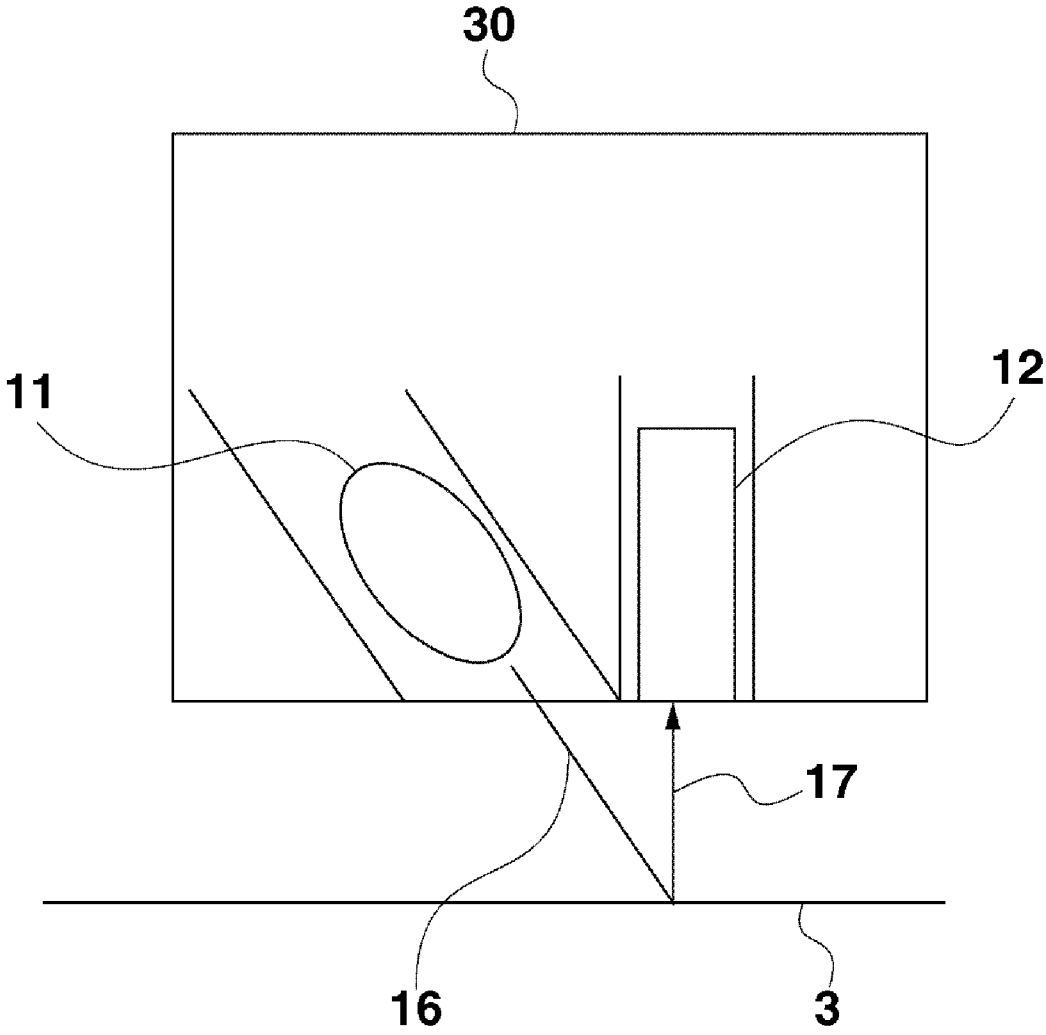
FIG. 2 is a schematic diagram illustrating a reflection type optical sensor.

FIG. 2 is a schematic diagram illustrating the reflection type optical sensor 30. The reflection type optical sensor 30 includes a light emitting unit 11 and a light receiving unit 12. Light 16 emitted from the light emitting unit 11 is reflected on the surface of a recording medium 3. There are light beams of specular reflection and irregular reflection as reflected light beams. In order to more accurately detect a density of an image recorded on the recording medium 3, desirably, an irregularly-reflected light beam 17 is detected. Thus, the light receiving unit 12 is disposed to be different in light incident angle from the light emitting unit 11. A signal detected to be acquired is transmitted to an electric substrate of the recording apparatus.

It is presumed that in order to perform registration adjustment for all the ink discharge heads including main ink and special ink of cyan (C), magenta (M), yellow (Y) and black (K), a white light-emitting diode (LED) or 3-color LED is used as the light emitting unit 11, and a photodiode having sensitivity in a visible light region is used as the light receiving unit 12. However, in the case of detecting a relationship between relative recording positions of over write recording and a density, when nozzle arrays of different inks are adjusted, the 3-color LED that enables selection of a color of high detection sensitivity can be used. As described below more specifically, for detection of the density of the image recorded on the recording medium 3, there is no need to detect an absolute value of a density, but detection of only relative densities is necessary. The recording apparatus only needs detection resolution that enables detection of a difference between relative densities in each pattern (also referred to as a patch) belonging to an adjustment pattern group described below.

Stability of a detection system including the reflection type optical sensor 30 only needs to be set to a level that gives no influence to a detection density difference before detection of a set of adjustment pattern groups. Sensitivity adjustment is performed by, for example, moving the optical sensor 30 to an unrecorded portion of the sheet. As an adjustment method, there is a method for adjusting emission intensity of the light emitting unit 11 or a gain of a detection amplifier in the light receiving unit 12 so that a detection level can be an upper limit value. While not essential, sensitivity adjustment can be used as a method for improving detection accuracy by increasing a signal/noise (S/N) ratio.

Space resolution of the reflection type optical sensor 30 is desirably set to a level that enables detection of an area smaller than a recording area of one adjustment pattern. In multipass recording that completes a predetermined area by performing recording and scanning a plurality of times, when adjustment pattern groups are recorded so that two pattern groups can be adjacent to each other in the scanning direction and the sub-scanning direction, a recording width of the sub-scanning direction is reduced according to the number of passes, and hence the number of recording passes limits sensor resolution. The number of recording passes (recording width) may be determined from the sensor resolution. A change in distance between the recording medium and the reflection type optical sensor causes a change in amount of light received by a phototransistor, and a distance between the recording medium and the carriage 4 (corresponding to a distance between the recording medium and the recording head) can be detected.

Figure 3:
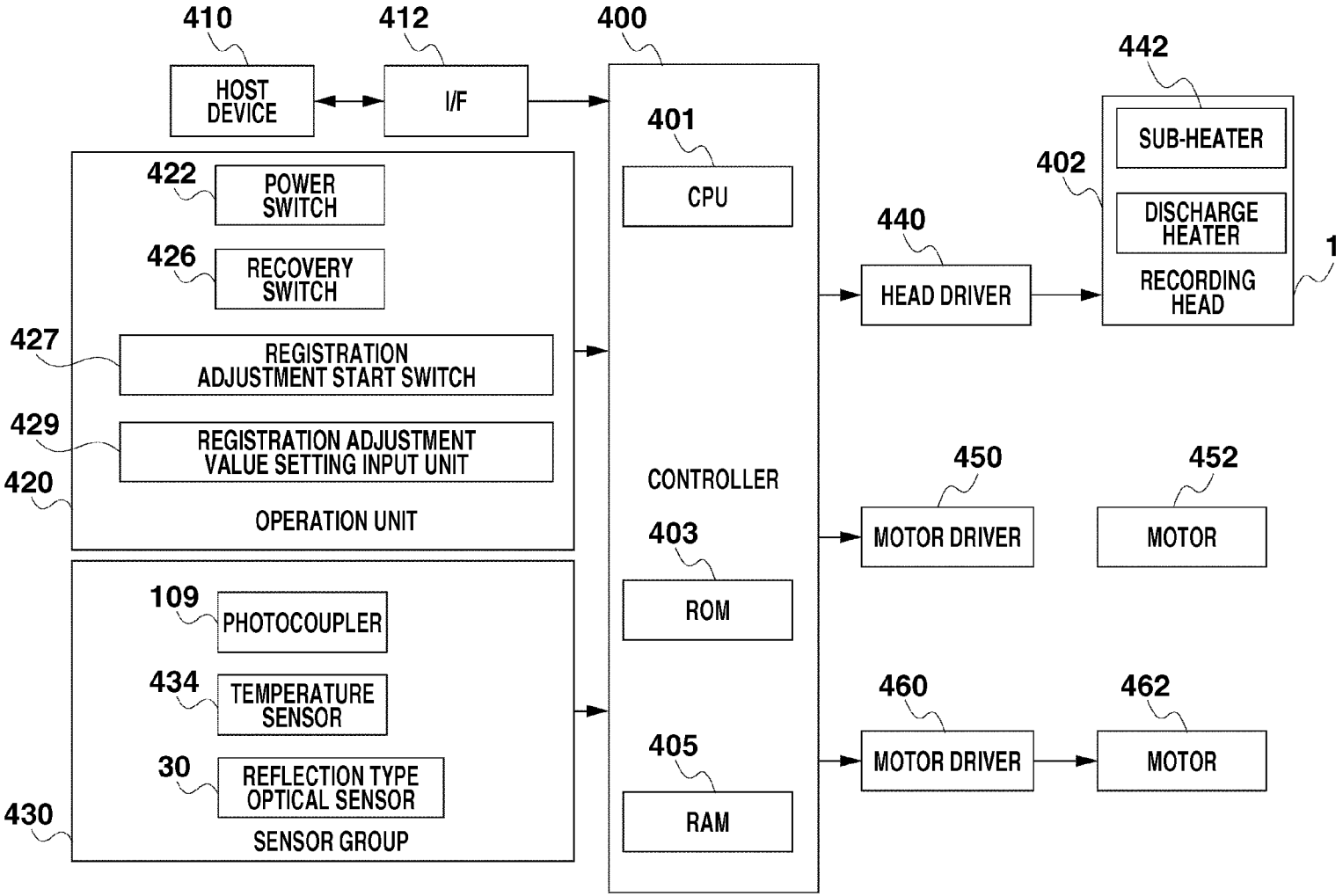
FIG. 3 is a control circuit block diagram illustrating the recording apparatus according to an exemplary embodiment of the present invention.

FIG. 3 is a block diagram illustrating a control circuit of the recording apparatus 2. A controller 400 is a main control unit that includes, for example, a CPU 401 in the form of a microcomputer, a ROM 403 for storing a program, a required table, and other fixed data, and a RAM 405 including an area for rasterizing image data or an area for working. A host device 410 is a supply source of image data. Specifically, the host device 410 may be a computer that generates or processes data such as an image relating to image recording, or a reader that reads images. Image data and other commands or status signals are transferred with the controller 400 via an interface (I/F) 412.

An operation unit 420 is a group of switches for receiving operator's instruction inputs. The operation unit 420 includes a power switch 422 and a recovery switch 426 for instructing a start of suction recovery. The operation unit 420 further includes a registration adjustment start switch 427 for performing manual registration adjustment, and a registration adjustment value setting input unit 429 for manually inputting an adjustment value. A sensor group 430 detects a state of the apparatus, and includes the reflection type optical sensor 30, a photocoupler 109 for detecting a home position, and a temperature sensor 434 disposed in an appropriate place to detect an ambient temperature.

A head driver 440 drives a discharge heater in the recording head 1 according to print data. The head driver 440 includes a shift register for arraying print data in association with a position of the discharge heater, and a latch circuit for latching data at appropriate timing. The head driver 440 further includes a logical circuit element for actuating the discharge heater in synchronization with a driving timing signal, and a timing setting unit for setting appropriate driving timing (discharge timing) to adjust a dot recording position.

The recording head 1 includes a sub-heater. The sub-heater adjusts a temperature to stabilize ink discharge characteristics, and can be formed on a print head substrate simultaneously with the discharge heater, or attached to a recording head body or a head cartridge. A motor driver 450 drives a carriage motor 452. A line feed (LF) motor 462 is used for conveying a recording medium, and a motor driver 460 is a driver for the LF motor 462.

Hereinafter, a recording position adjustment method according to the present exemplary embodiment will be described in detail. The recording position adjustment method according to the present exemplary embodiment is characterized by changing a shift amount of a recording position for each raster to perform recording position adjustment in a plurality of positions of the scanning direction. As a result, even if an interval between dots is greatly changed when a recording position shift amount is changed in a plurality of positions of the scanning direction, a position of the scanning direction where an interval greatly changes is different from one raster to another, and hence deterioration of image quality can be reduced.

Figure 4:
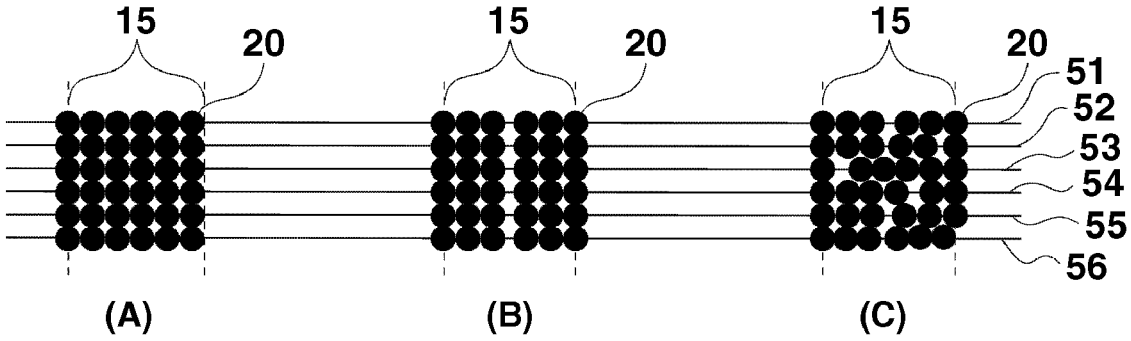
FIG. 4 illustrates features of a recording position adjustment method according to an exemplary embodiment of the present invention.

FIG. 4 illustrates features of the recording position adjustment method according to the present exemplary embodiment. FIG. 4 illustrates dot arrangement A where no recording position adjustment is performed in a plurality of positions of the scanning direction, dot arrangement B where recording position adjustment is performed in a plurality of positions of the scanning direction by a conventional method, and dot arrangement C where recording position adjustment is performed in a plurality of positions of the scanning direction by the recording position adjustment method according to the present exemplary embodiment.

FIG. 4 illustrates examples of arranging six dots for each of six rasters 51 to 56. In the present exemplary embodiment, multipass recording is performed, and recording is performed by the same pass in the same raster. In other words, recording is performed by the first pass, the second pass, the third pass, the fourth pass, the fifth pass, and the sixth pass, respectively, in the rasters 51 to 56.

In the dot arrangement A in FIG. 4, no recording position adjustment is performed in a plurality of positions of the scanning direction, and hence, recording position deviation occurs in a target recording position at the right side. On the other hand, when recording position adjustment is performed for a plurality of target recording positions as in the case of the dot arrangement B in FIG. 4, recording position deviation amounts from the target recording positions are constant in the same raster (same pass). Thus, recording position adjustment is performed in the same position of the scanning direction. In this case, a gap is generated between dots to form a white streak. Alternatively, dots overlap each other in the scanning direction to generate a black streak.

In the exemplary embodiment, as in the case of the dot arrangement C in FIG. 4, a recording position shift amount is changed for each raster (each pass) to reduce generation of streaks. In other words, in the raster 51, a recording position shift amount is changed in the same position as that of the dot arrangement B in FIG. 4. In the raster 52, a recording position shift amount is changed by timing two steps after the raster 51. Similarly, in the raster 53, a recording position shift amount is changed by timing two steps before the raster 51. In the raster 54, a recording position shift amount is changed by timing one step after the raster 51. In the raster 55, a recording position shift amount is changed by timing one step before the raster 51. In the raster 56, a recording position shift amount is changed by the same timing as that of the raster 51.

As described above, in the recording position adjustment method according to the present exemplary embodiment, the recording position shift amount is changed for each raster, and positions where discharge timing changes are dispersed. As a result, generation of streaks can be reduced.

Figure 5:
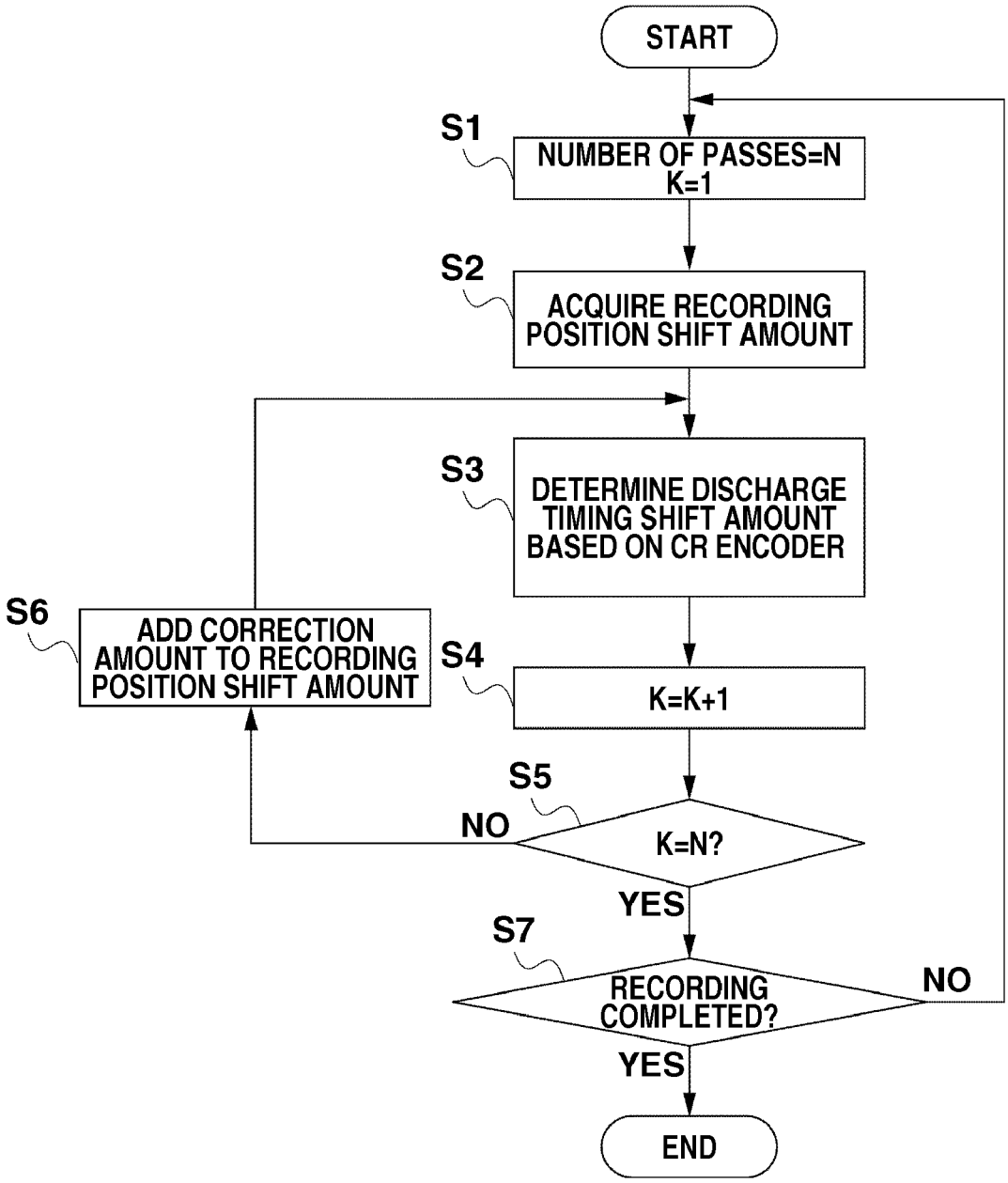
FIG. 5 is a flowchart illustrating a procedure of the recording position adjustment method according to an exemplary embodiment of the present invention.

Next, a procedure of the recording position adjustment method according to the present exemplary embodiment will be described. FIG. 5 is a flowchart illustrating the procedure of the recording position adjustment method according to the present exemplary embodiment. In the recording position adjustment method, the CPU 401, which is a control unit, reads a program stored in the RAM 403 to execute the program.

In step S1, the CPU 401 identifies the number of passes N for multipass recording. The CPU 401 determines the number of passes based on control information (image quality and recording medium) received together with image data from the host device 410. In step S1, the CPU 401 sets a counter K to 1. The counter K is used for recording an image of a predetermined area, and enables monitoring of which pass is used for current recording of an image.

In step S2, the CPU 401 acquires a recording position shift amount stored in the ROM 403. This recording position shift amount is calculated from a detection result of the reflection type optical sensor to be stored in the ROM 403, and a plurality of values is set according to a scanning direction. A method for calculating the recording position shift amount will be described below.

In step S3, the CPU 401 converts a shift amount based on a recording position into a shift amount based on discharge timing to determine a discharge timing shift amount. In order to shift discharge timing, the CPU 401 shifts generation timing of a heat signal to discharge ink based on a trigger generated based on a carriage encoder. When shifting the discharge timing, the CPU 401 may perform an operation based on the carriage encoder or the trigger generated based on the carriage encoder.

In step S4, the CPU 401 counts up a value of the counter K when one scanning (recording of one pass) is completed to move to a next pass.

In step S5, the CPU 401 compares and checks the number of passes N for multipass recording with the value of the counter K. If the value of the counter K is smaller than the number of passes N, in other words, if multipass recording of a predetermined area is yet to be completed, the CPU 401 proceeds to step S6. On the other hand, in the case of N=K, the CPU 401 proceeds to step S7.

In step S6, the CPU 401 adds a correction amount different from one pass to another to the recording position shift amount to increase/decrease the recording position shift amount for each pass. After step S6, the CPU 401 repeats the processing of step S3 and after. This processing method will be described below.

In step S7, the CPU 401 checks whether the recording has been completed. If the recording is yet to be completed, the CPU 401 repeats the same operation from step S1.

In the present exemplary embodiment, a plurality of values are set for the recording position shift amount according to a scanning direction, and calculated as values to cancel the recording position deviation amounts acquired in the plurality of positions.

Figure 6:
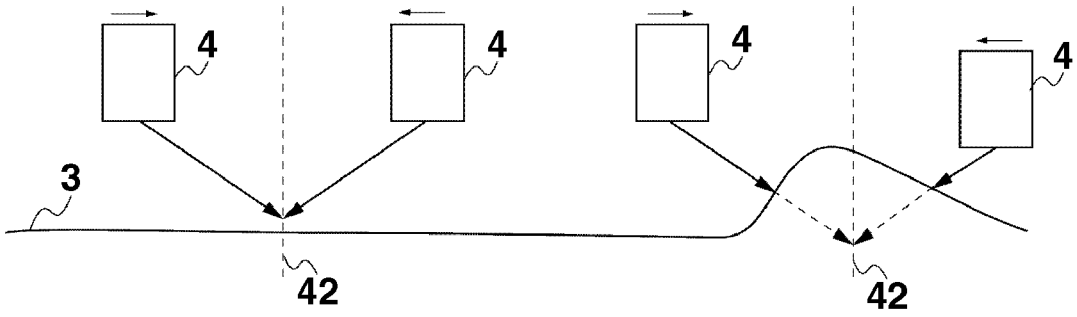
FIG. 6 illustrates a change in distance between a recording medium and a recording head.

First, referring to FIG. 6, recording position deviation when a distance between the recording medium and the recording head changes in the scanning direction will be described. FIG. 6 is a sectional diagram illustrating a change in distance between the recording medium 3 and the carriage 4 (recording head 1) (hereinafter, may also be referred to as head-to-paper distance) in the scanning direction. If the head-to-paper distance is not equal to a predetermined distance, deviation occurs between a position of recording in a forward direction of carriage movement and a position of recording in a backward direction. When discharge timing is determined for each of the forward and backward directions so that recording positions can match each other between the forward direction and the backward direction at a specific position, and recording is performed in all the scanning-direction areas by this discharge timing, recording position deviation occurs if there is a change in head-to-paper distance.

Thus, as illustrated in FIG. 6, recording position deviation amounts of the forward and backward directions must be calculated for each plurality of positions (target recording positions 42) of the scanning direction to determine discharge timing. In this case, advisably, position deviation amounts of the forward and backward directions are calculated, and ink discharge timing is adjusted by ½ each in the forward direction and the backward direction for the recording position deviation amounts.

Next, the method for calculating a recording position deviation amount will be described. A recording position deviation amount can be calculated based on a head-to-paper distance, an ink flying speed, and a carriage moving speed, and measured by the reflection type optical sensor 30 mounted on the carriage.

Figure 7:
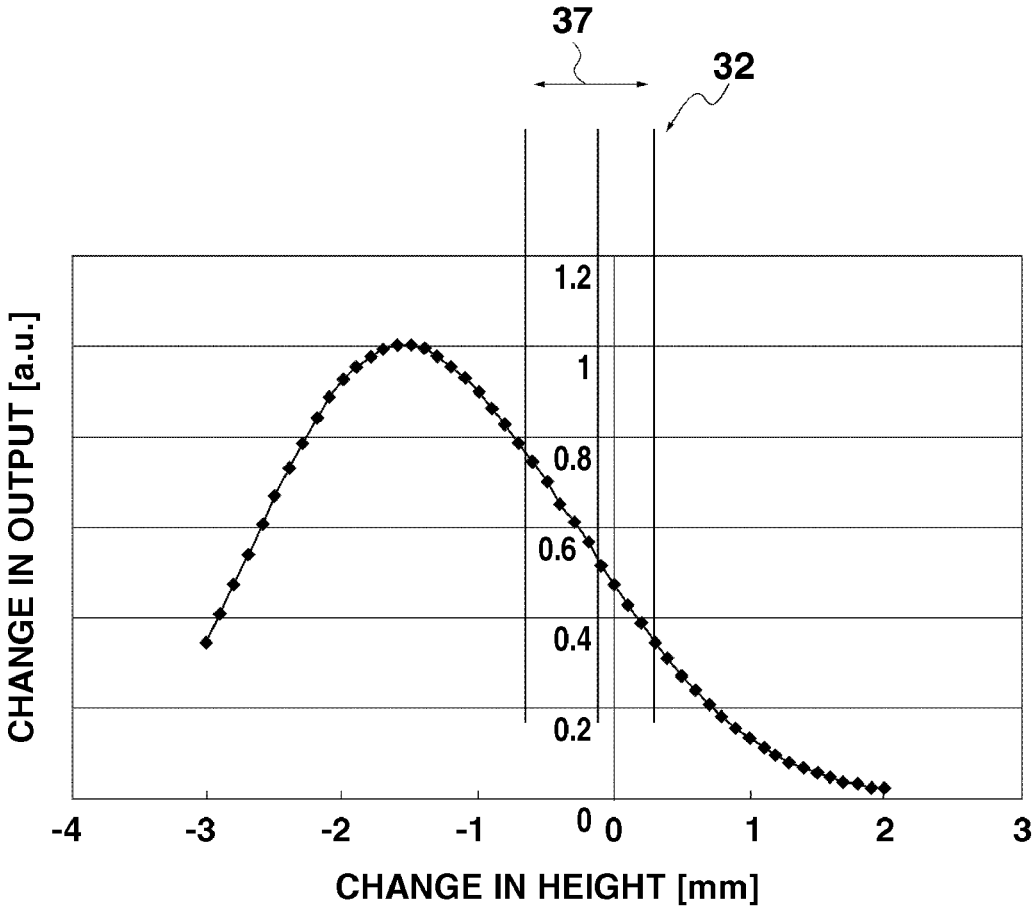
FIG. 7 illustrates an output change of the reflection type optical sensor.

FIG. 7 illustrates a change in output of the reflection type optical sensor 30 when a distance from the recording medium is changed. In FIG. 7, a reference height 32 is set for the recording medium on a platen, and a change in height position of the recording medium is accompanied by a change in a head-to-paper distance. A height change area 37 is set for the recording medium. In the height change area 37, arrangement of the light emitting unit and the light receiving unit in the reflection type optical sensor is determined so as to keep an almost linear output change.

For example, a reference height is set to "0 mm" and, for output values in this case, relative output values of "−0.3 mm" and "0.3 mm" are acquired. The linear output change is kept in the height change area 37, and hence, consideration will be given to an exemplary case where an output of a height position "−0.3 mm" is "0.4 (relative value)" and an output of a height position "0.3 mm" is "0.6 (relative value)". In this case, when an output of the optical sensor is "0.5 (relative value)", a height is detected to be "0 mm". In other words, calibrating the output of the reflection type optical sensor in the reference height beforehand enables acquisition of a height change from the output of the reflection type optical sensor. In order to calibrate element variance of the light emitting LED and the light receiving phototransistor, the light emitting side may adjust an emission amount, and the light receiving side may adjust an amplification degree.

Such output value adjustment is performed, and head-to-paper distances are measured in a plurality of positions of the scanning direction by using the reflection type optical sensor. The number of measuring points is optional. However, a greater number of measuring points enable more accurate correction of recording position deviation even when a change occurs in head-to-paper distance.

Then, based on the measured head-to-paper distance, a carriage scanning speed, and an ink flying speed, a recording position deviation amount is calculated by the following expression (1):

$$\text{"Impact deviation amount"} = \text{"head-to-paper change amount"} / \text{"ink flying speed"} \times \text{"carriage scanning speed"} \times 2 \quad (1)$$

Figure 8:
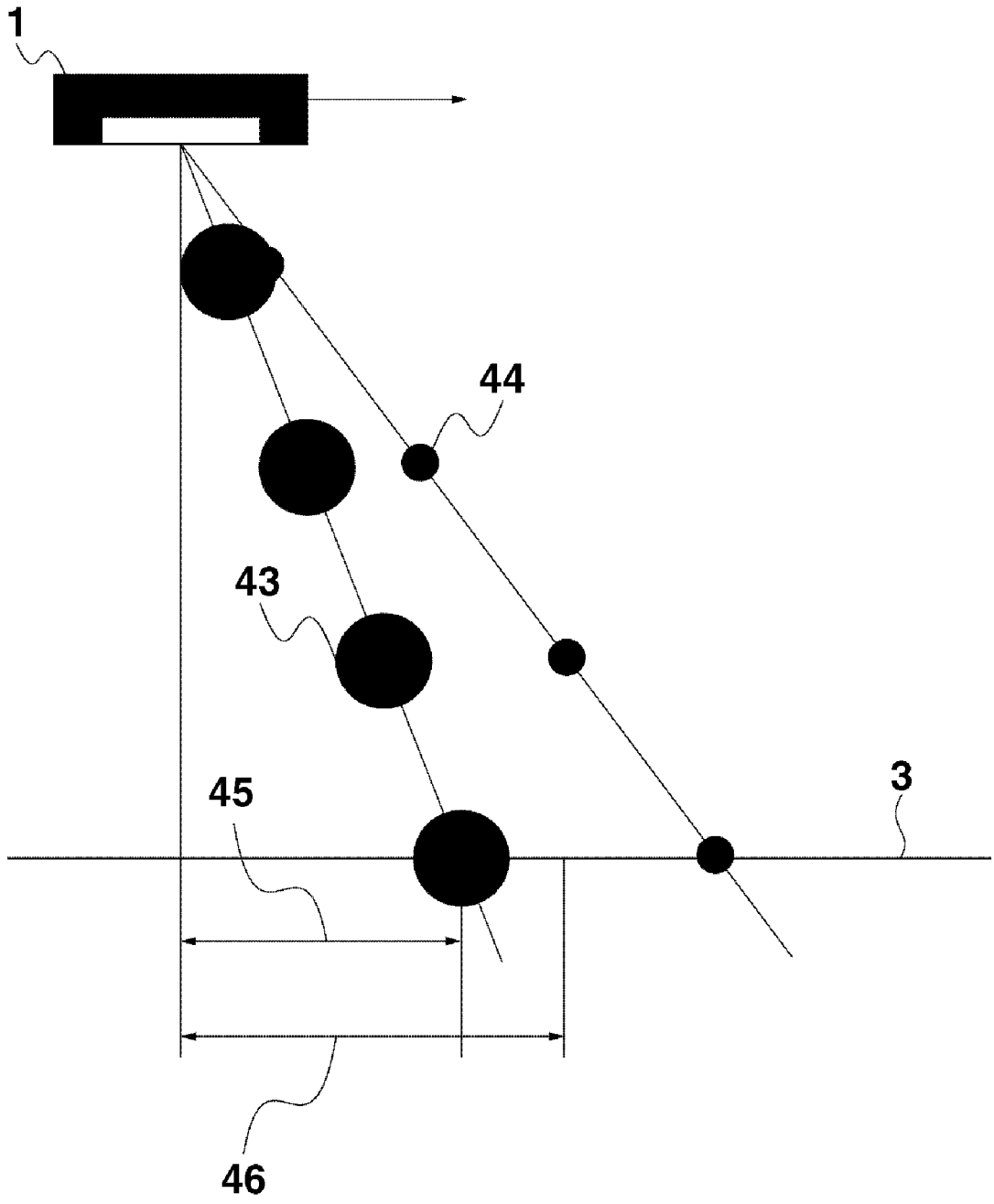
FIG. 8 illustrates flying states of a main droplet and a satellite droplet.

The ink flying speed will be described. FIG. 8 is a conceptual diagram illustrating a flying state of ink droplets discharged from the recording head 1. Specifically, FIG. 8 illustrates a main droplet 43, a satellite droplet 44, a recording position deviation amount 45 of the main droplet, and a recording position deviation amount 46 that is obtained by taking the satellite droplet into consideration.

The ink flying speed can be determined mainly based on a main droplet discharge speed. However, as illustrated in FIG. 8, when there are many satellite components for the main droplet, an optimal recording position is different from an impact position of the main droplet. For example, in FIG. 8, a recording position of the main droplet is position 45, while recording positions of the satellite droplets are far from that of the main droplet. When viewed, a position overlapping the main droplet and the satellite droplet is a center position of this liquid droplet. Thus, a recording deviation amount is to be corrected by taking the satellite droplets in FIG. 8 into consideration. This correct recording deviation amount can be appropriately calculated based on an ink flying speed taking a discharge speed of the main droplet, a discharge speed of the satellite droplet, a size of the main droplet, and a size of the satellite droplet into consideration. The ink flying speed is a speed that enables calculation of a recording position taking the satellite droplet into consideration.

Experimentally, when the size of the main droplet, the size of the satellite droplet, and the discharge speeds thereof are taken into consideration, the ink flying speed is about ¾ of the discharge speed of the main droplet. Thus, for example, the ink flying speed may be set to ¾ of an ink discharge speed. From the discharge speeds and the sizes, the ink flying speed may be calculated by the following expression (2):

$$\text{“Ink flying speed”}=(M\times Vs+S\times V)/(M\times S) \quad (2)$$

M: size of the main droplet
V: discharge speed of the main droplet
S: size of the satellite droplet
Vs: discharge speed of the satellite droplet A head-to-paper distance mainly depends on flatness of the platen in the scanning direction. Depending on stiffness of the recording medium, however, there are a head-to-paper distance having a change amount matched with the flatness of the platen and a head-to-paper distance having a change amount different from the flatness of the platen. Thus, in the case of measuring head-to-paper distances in a plurality of positions in the scanning direction, the distances can be acquired for each recording medium. In the recording medium, recording may cause cockling of the recording medium, and hence a change in head-to-paper distance caused by the cockling can be taken into consideration. Thus, adding a correction amount of each recording pass to the measured head-to-paper distance enables more accurate acquisition of a head-to-paper distance. As a method for detecting the head-to-paper distance, in addition to a method for direct detection by the reflection type optical sensor according to the present exemplary embodiment, a method using a test pattern may be used.

Figure 9:
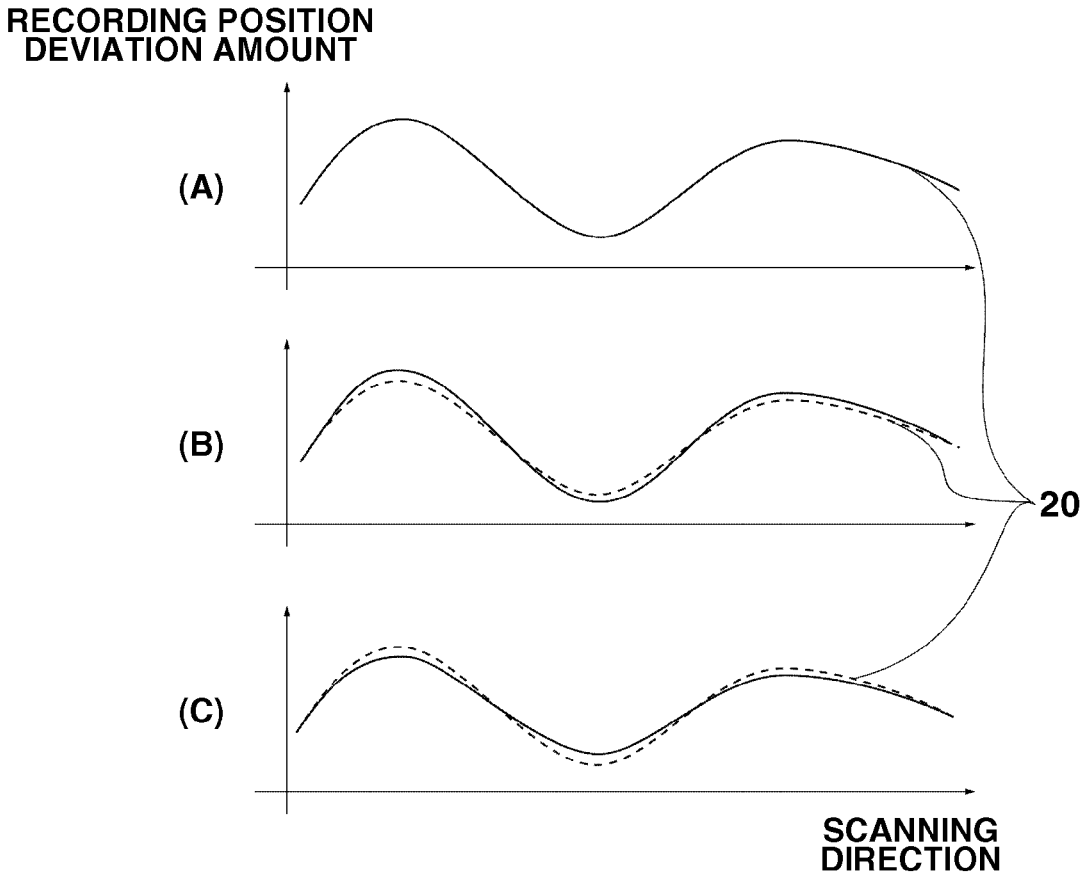
FIG. 9 illustrates an outline of a method for changing a recording position shift amount.

Next, the method for generating a recording position shift amount (step S6 in FIG. 5) will be described. First, an outline of a method for changing a recording position shift amount for each pass according to the present exemplary embodiment will be described. FIG. 9 illustrates relationships of the first pass A to the third pass C between a position in the scanning direction and a recording position deviation amount when the recording position shift amount is changed for each pass.

In the first pass A in FIG. 9, a recording position shift amount (discharge timing) is calculated from original data indicating a recording position deviation amount. In the second pass B in FIG. 9, amplitude of an original recording position deviation amount is changed, and a recording position shift amount (discharge timing) is generated from the changed recording position deviation amount. Changing the original data of the recording position deviation amount in this way enables shifting of timing for correcting the discharge timing. In this case, as compared with direct shifting of the discharge timing, a recording position deviation amount caused by the change of the shift amount can be appropriately managed. Similarly, in the third pass C in FIG. 9, the amplitude of the original recording position deviation amount is changed to be different from that of the second pass, and a recording position shift amount (discharge timing) is generated from the changed recording position deviation amount.

As illustrated in FIG. 9, a total shift amount can be reduced by generating recording position shift amounts so that an average value of the three recording position deviation amounts can be as close as possible to or match the original recording position deviation amount.

Figure 10:
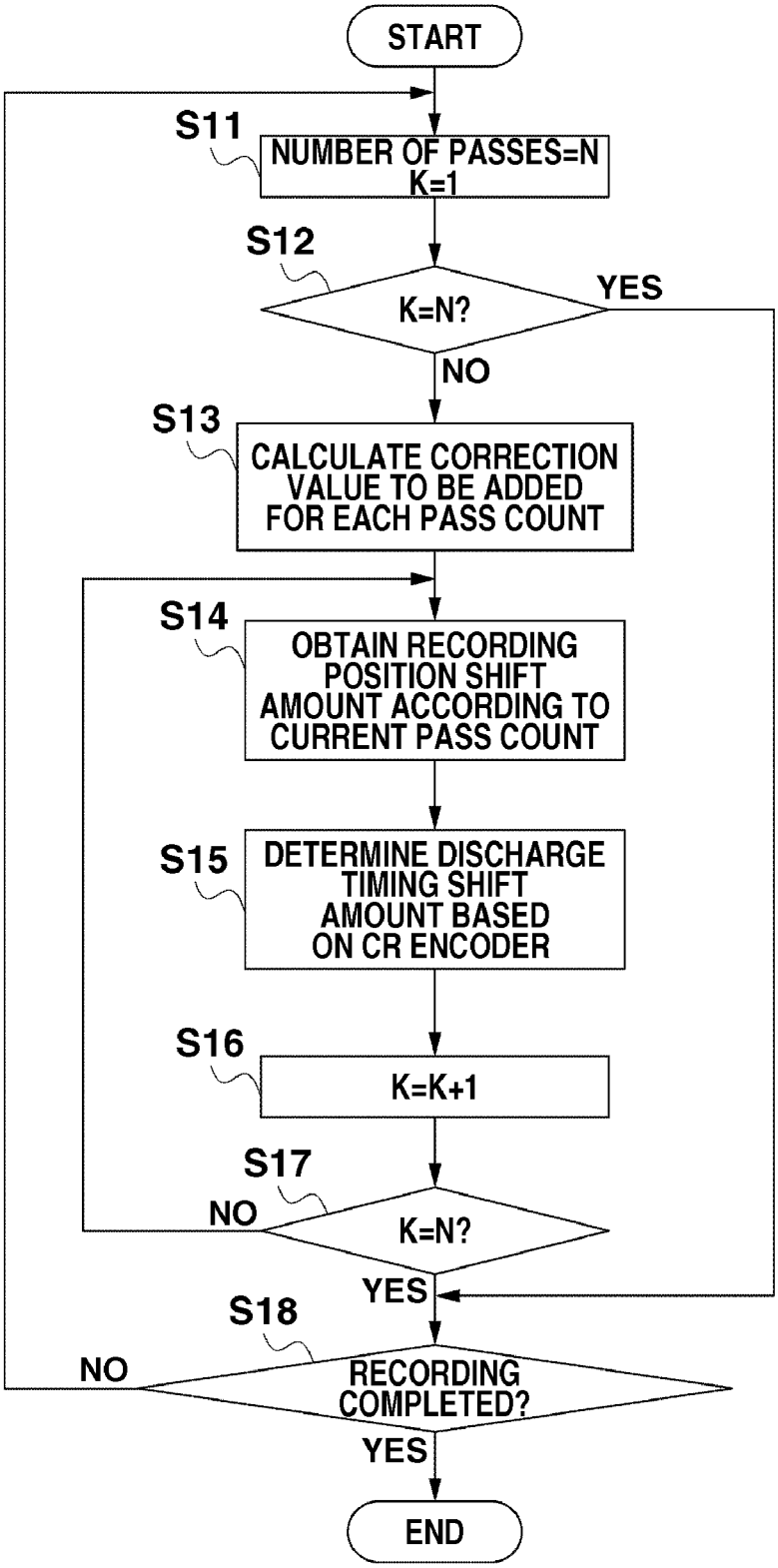
FIG. 10 is a flowchart illustrating a procedure of changing a recording position deviation amount.

FIG. 10 is a flowchart illustrating a procedure of adding a correction amount to a recording position deviation amount of each pass to change a recording position shift amount for each pass. As in the case according to the present exemplary embodiment, when a recording position shift amount is changed for each pass, image forming units (six times for 6-pass recording) can constitute one set of the deviation shift amounts.

In step S11, the CPU 401 identifies the number of passes N and the number of current recording passes (pass count) K. This processing is similar to step S1 of the flowchart in FIG. 6.

In step S12, the CPU 401 determines whether N=K to check whether counting-up of a predetermined number of passes has been performed. If the pass count K is smaller than the predetermined number of passes N, the CPU 401 proceeds to step S13. If the pass count K is equal to the predetermined number of passes N, the CPU 401 proceeds to step S18.

In step S13, the CPU 401 calculates a correction amount to be added according to the pass count K. Correction amounts may be prepared beforehand as a table in the ROM 403 according to pass counts.

In step S14, the CPU 401 adds the correction amount calculated in step S13 to a recording position deviation amount to identify a recording position shift amount at a current pass. If the correction amounts have been stored as a table, the CPU 401 refers to correction amount parameters contained in the table to determine a recording position shift amount.

In step S15, the CPU 401 generates a discharge timing shift amount based on the carriage encoder from the recording shift amount.

In step S16, when proceeding to a next pass after completion of the first recording pass, the CPU 401 counts up the pass count K. In step S17, the CPU 401 determines whether N=K to check whether counting-up of a predetermined number of passes has been performed. If the pass count K is equal to the number of passes N, the CPU 401 proceeds to next processing. The equality of the pass count K to the number of passes N means completion of image processing of a predetermined area. If the pass count K is smaller than the number of passes N, the CPU 401 returns to step S14 to repeat steps thereafter.

In step S18, the CPU 401 determines whether recording has been completed. If recording is not yet completed, the CPU 401 repeats the same processing from step S11, and continues this processing until recording is completed.

As described above, the recording position adjustment method according to the present exemplary embodiment is characterized by changing a recording position shift amount for each raster when performing recording position adjustment in a plurality of positions in the scanning direction. Thus, even if an interval between dots greatly changes when the recording position shift amount is changed in a plurality of positions in the scanning direction, a position in the scanning direction where the interval greatly changes varies from one raster to another. As a result, deterioration of image quality can be reduced.

Effects of the recording position adjustment method according to the present exemplary embodiment will be described.

Figure 11:
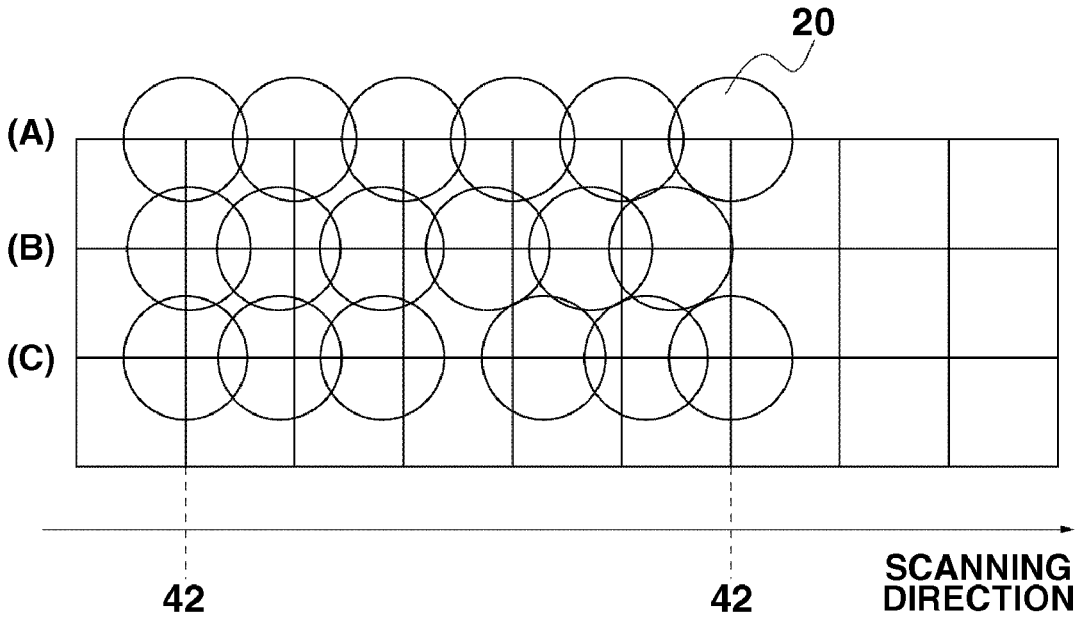
FIG. 11 illustrates changes in dot arrangement by recording position adjustment.

FIG. 11 illustrates dot arrangement A of an ideal recording position (there is no recording position deviation), dot arrangement B where no recording position adjustment is performed, and dot arrangement C where recording position adjustment is performed. In the dot arrangement A in FIG. 11, when corners of squares arranged in a lattice shape are target recording positions, recording has successfully been done in ideal recording positions, and all points are recorded at the corners in the scanning direction of the carriage. In actual recording, however, due to a change in head-to-paper distance, the dot arrangement may be shifted as in the case of the dot arrangement B in FIG. 11. When minimum correction resolution is 4 μm, a change in recording position shift amount in the center (position half of resolution of recording position adjustment) between target recording positions 42 as in the case of the dot arrangement C in FIG. 11 reduces a deviation amount most.

Figure 12:
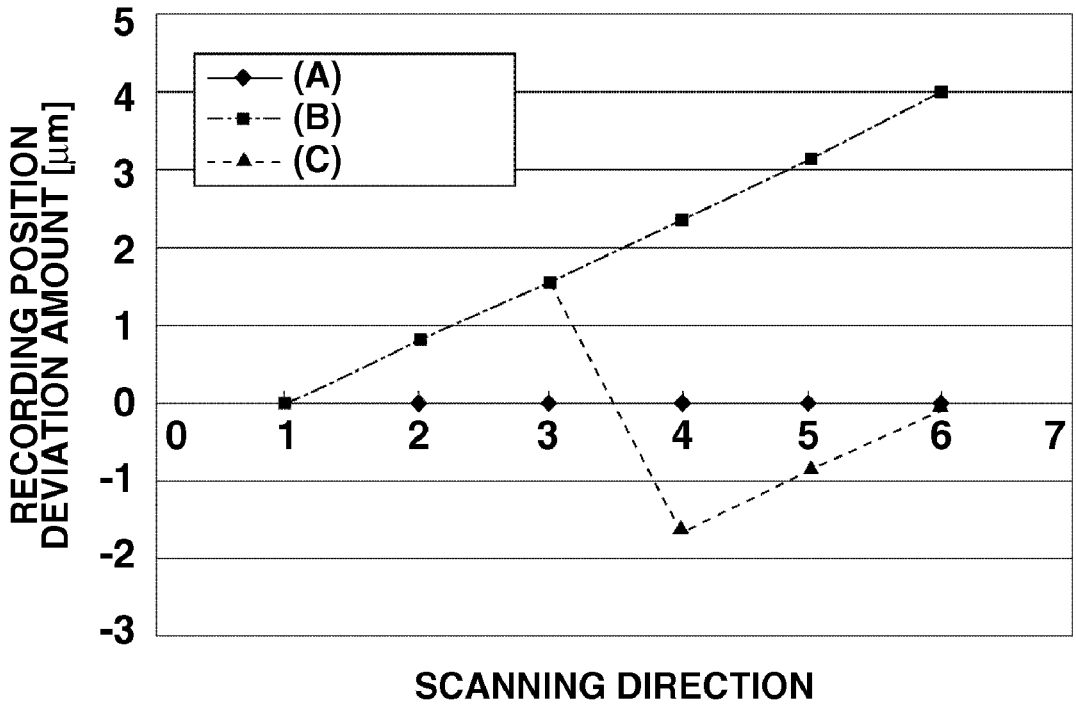
FIG. 12 illustrates recording position deviation amounts in three states in FIGS. 11A to 11C.

FIG. 12 illustrates recording position deviation amounts in the three states A to C in FIG. 11. In the state A in FIG. 12, a deviation amount is 0 μm in an ideal recording position. On the other hand, in the state B in FIG. 12 where no recording position adjustment is performed, recording position deviations are greater as carriage scanning positions advance, and a maximum deviation amount is 4 μm in FIG. 12. FIG. 12 is a schematic diagram illustrating linear changes. In reality, however, changes are not always linear. In the state C in FIG. 12 where recording position adjustment is performed, the recording position adjustment is performed so that a deviation amount changes in the position half of the resolution of the recording position adjustment, and hence a maximum deviation amount is about 1.6 μm.

Figure 13:
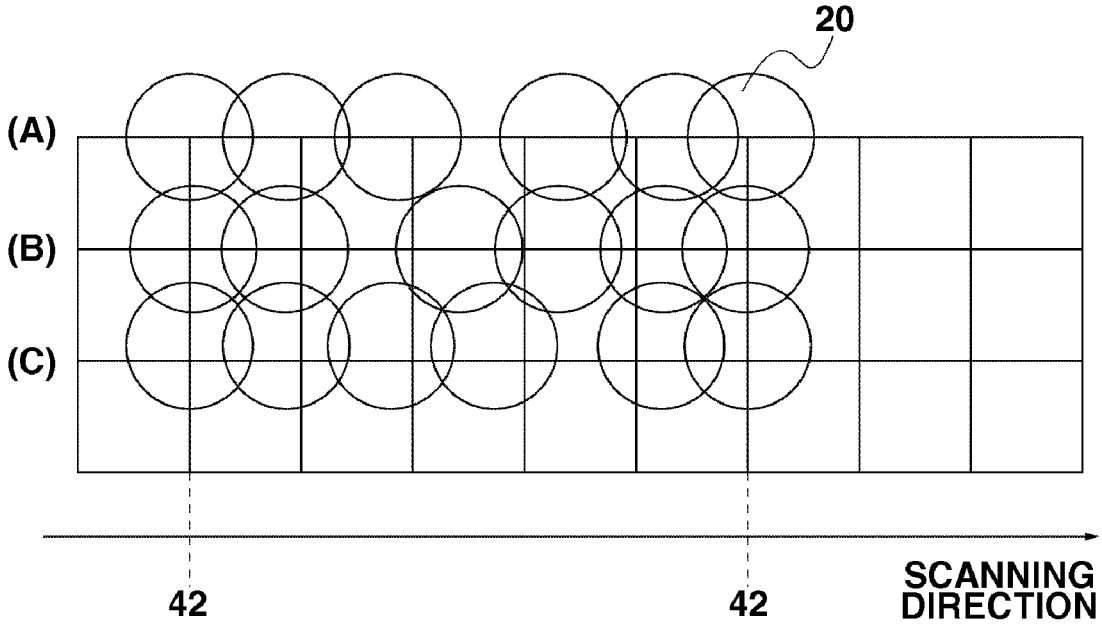
FIG. 13 illustrates dot arrangements when a recording position shift amount is changed.
Figure 14:
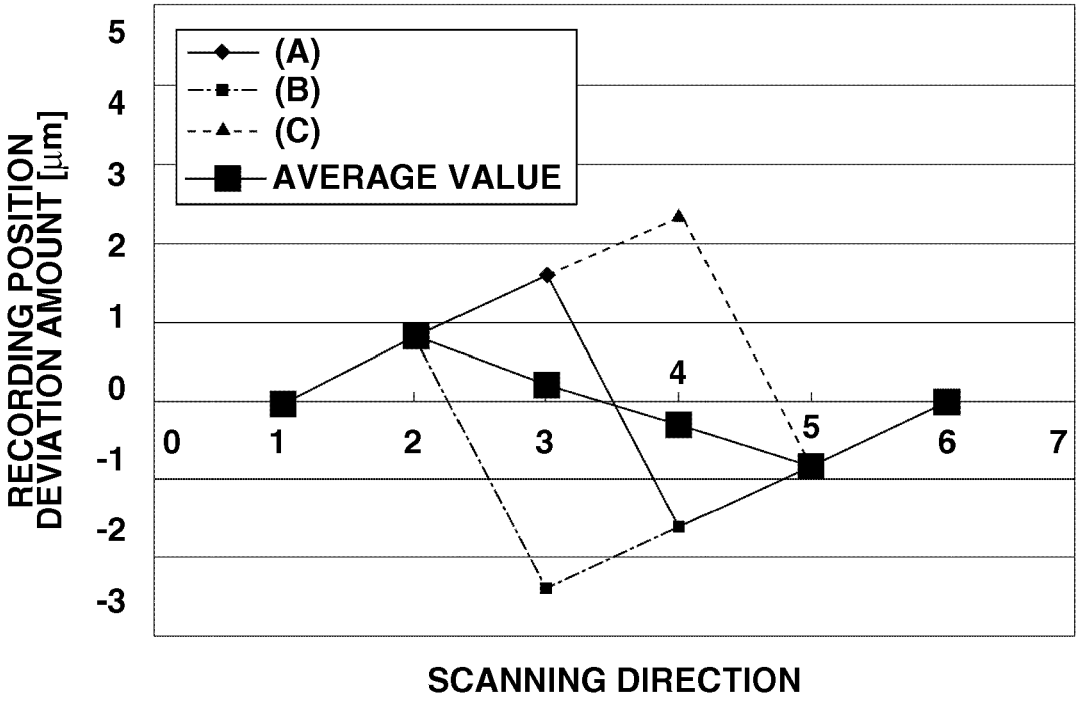
FIG. 14 illustrates an average deviation amount in the dot arrangement in FIG. 13.

FIG. 13 illustrates dot arrangements when a recording position shift amount is changed for each pass (each raster). In FIG. 13, an uppermost raster is recorded at the first pass, a center raster is recorded at the second pass, and a lowermost raster is recorded at the third pass. At the first pass, a change point of the recording position shift amount is similar to that of the state C in FIG. 11 where the recording position adjustment is performed. At the second pass, adjustment is performed so that the recording position shift amount can be changed in a position one step before in the carriage scanning direction. At the third pass, adjustment is performed so that the recording position shift amount can be changed in a position one step after. When a maximum recording position deviation amount is examined for each raster, maximum deviation amounts are respectively about 1.6 μm at the first pass and about 2.4 μm at the second and third passes. However, one line is recorded at the three passes, and hence an average value of deviation amounts of the three passes is actually seen, and a maximum deviation amount is about 0.8 μm as illustrated in FIG. 14. Thus, in multipass recording, changing a recording position shift amount for each pass enables improvement of adjustment accuracy of dots to be recorded.

In the present exemplary embodiment, the change in head-to-paper distance is cited as a cause of a change in recording position deviation in the scanning direction. However, other factors may also cause changes in recording position deviation in the scanning direction. Thus, not only the head-to-paper distance in the scanning direction but also other factors can be measured to calculate changes in recording position deviation. For example, the other factors causing changes in recording position deviation in the scanning direction include an orientation change of the carriage. Hereinafter, a method for measuring recording position deviation based on an orientation change of the carriage will be described.

Figure 15:
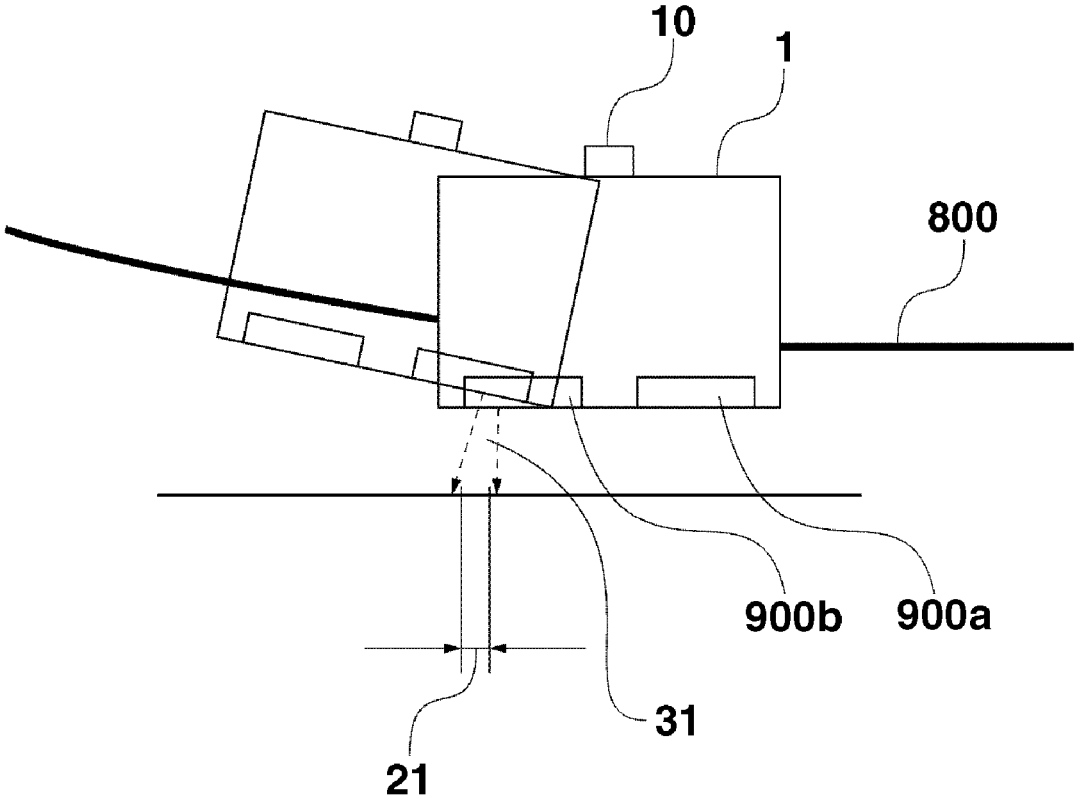
FIG. 15 illustrates a change in recording position deviation caused by an orientation change of the carriage.

FIG. 15 illustrates a change in recording position deviation caused by an orientation change of the carriage. FIG. 15 specifically illustrates a main rail 800, nozzle arrays 900*a* and 900*b*, a carriage encoder 10, an ink discharge direction 31, and recording position deviation 21. For example, assuming a case where the main rail 800 is slightly bent, an orientation of the carriage 4 is oblique to the platen in a given position, and parallel to the platen in another position.

The nozzle arrays 900*a* and 900*b* of the recording head mounted on the carriage 4 are arranged to be shifted from each other in the scanning direction. In the case of recording in the same position on the recording medium by each nozzle array, discharge timing shifts by an amount equal to a period of time considering an interval between the two nozzle arrays and a carriage scanning speed. Thus, when recording is performed in the same position on the recording medium by the nozzle arrays 900*a* and 900*b*, positions of the scanning directions are different between the nozzle arrays at the time of discharging ink, and hence orientations of the carriage may be different. The different orientations of the carriage cause shifting of a position of dots recorded in the same position. If an orientation of the carriage is constant in all the carriage scanning areas, the deviation amount can be corrected with a fixed value. However, if an orientation changes from one carriage position to another, the deviation amount cannot be corrected with a fixed value.

If the main rail is supported at two end points, deflection may occur in the two-point support center when the carriage is scanned. The main rail is supported by a support member 700 (FIG. 16) to sufficiently reduce a deflection amount. However, when the support member 700 has tolerance for a reference position of the main rail, an inflection point is provided in this position. As a result, measuring a recording deviation amount around this inflection point enables measurement of a total recording deviation amount of the carriage.

Figure 16:
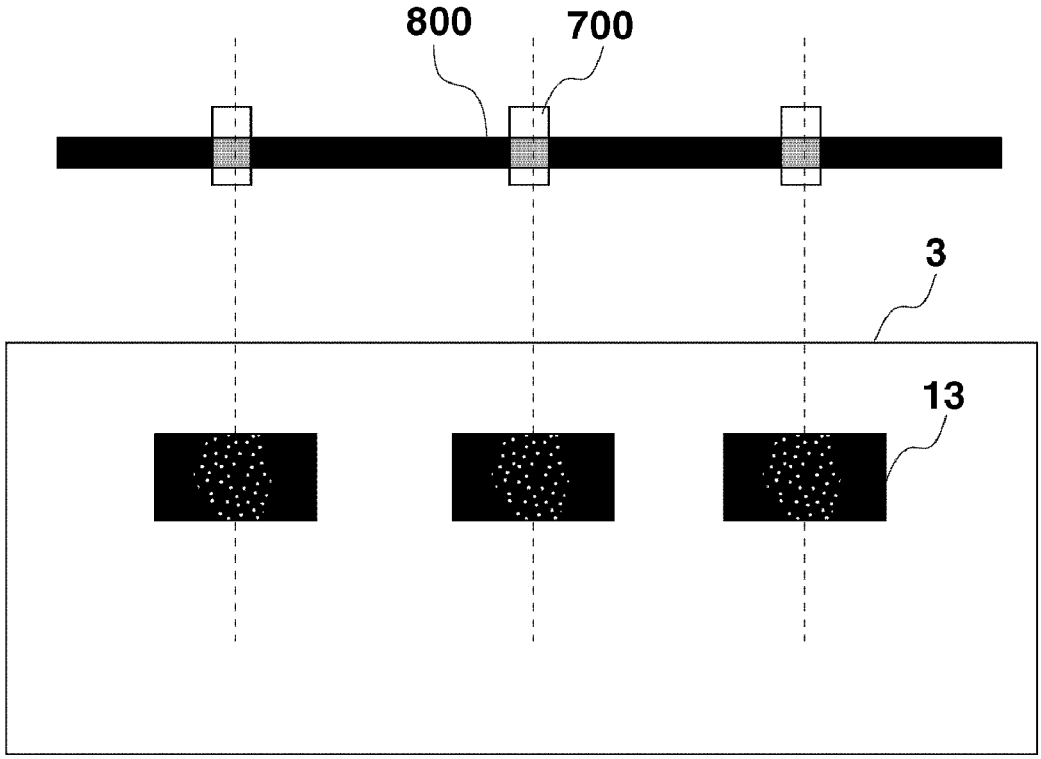
FIG. 16 illustrates an adjustment pattern for detecting the orientation change of the carriage.

FIG. 16 illustrates adjustment patterns 13 for detecting recording position deviation caused by an orientation change of the carriage in a plurality of positions in the scanning direction. As illustrated in FIG. 16, arranging the pasterns for detecting the recording position deviation amount in the support members 700, in other words, positions causing carriage orientation changes, enables calculation of recording position deviation amounts in all the carriage scanning areas.

Figure 17:
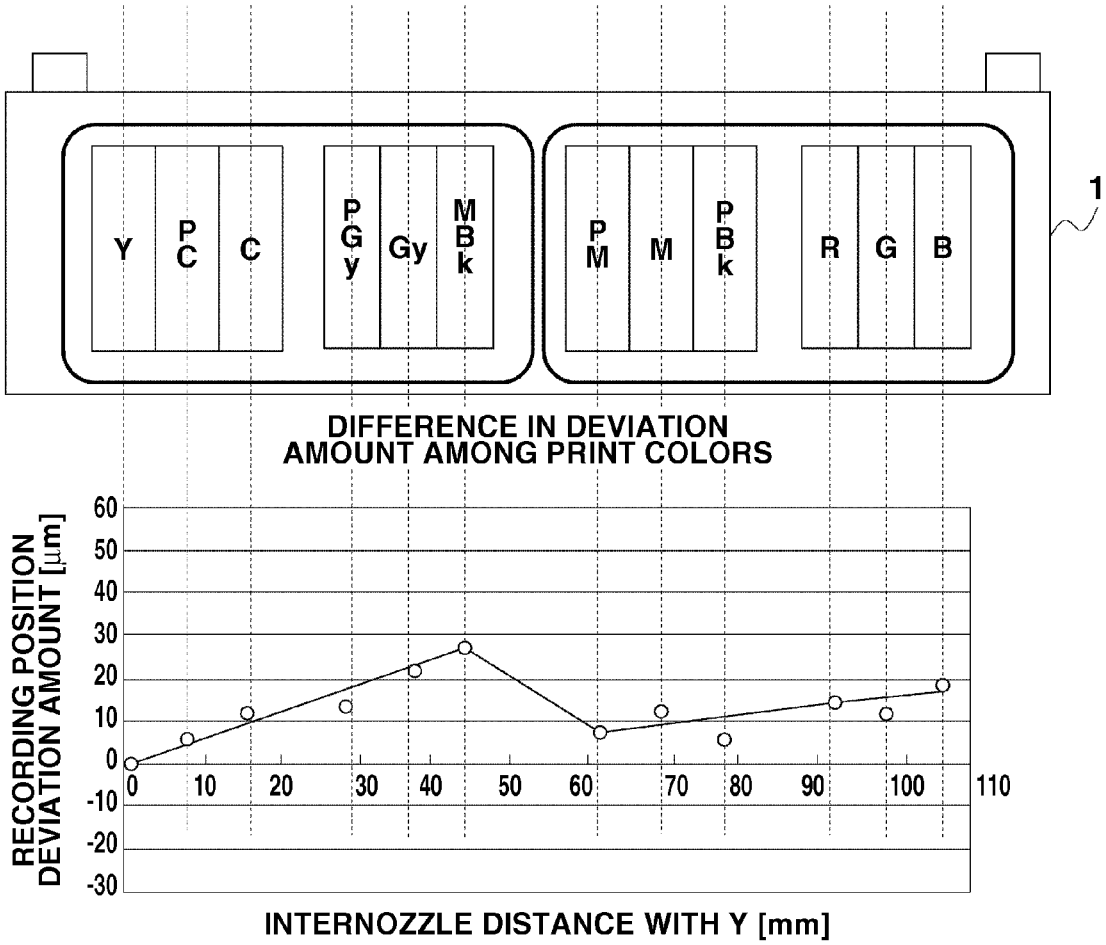
FIG. 17 illustrates a recording position deviation example of the recording apparatus that includes 12-color ink.

FIG. 17 illustrates an example of recording position deviation of the recording apparatus that includes 12-color ink. The 12 colors are yellow (Y), photo cyan (PC), cyan (C), photo gray (PGy), gray (Gy), mat black (MBk), photo magenta (PM), magenta (M), photo black (PBk), red (R), green (G), and blue (B). Nozzle arrays corresponding to these inks are arranged as illustrated in FIG. 17.

A lower portion in FIG. 17 illustrates recording position deviation amounts of 12 colors in the recording head 1. As understood from FIG. 17, six colors at the right side and six colors at the left side exhibit different recording position deviation tendencies. The different tendencies are due to fixing of a carriage orientation around the two-point support center, and greater in influence than attachment errors of the nozzle arrays. Thus, adjustment values of the 12 colors are calculated by acquiring the recording position deviation tendency at the right side and the recording position deviation tendency at the left side.

Figure 18:
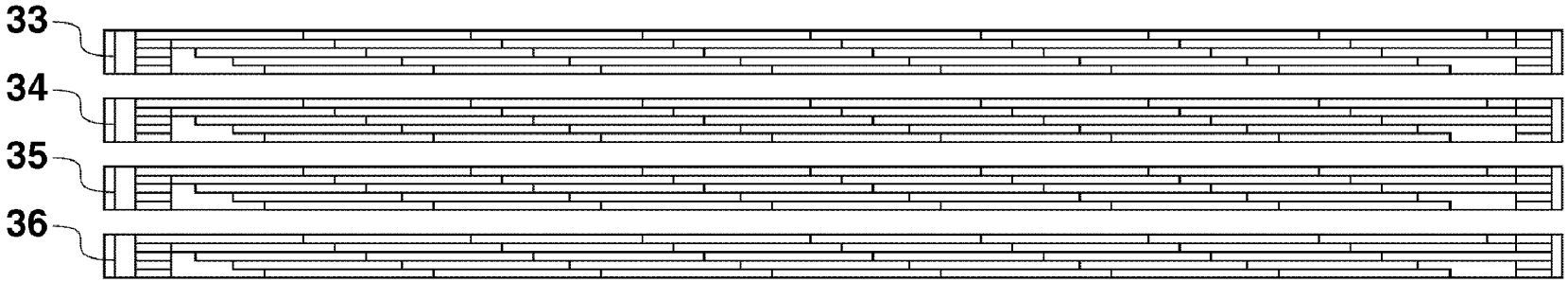
FIG. 18 illustrates all patterns for detecting a recording position deviation amount.

FIG. 18 illustrates all the patterns for detecting recording position deviation amounts: an adjustment pattern A 33 recorded by both-end nozzles (Y and Mbk) of the six colors at the left side, an adjustment pattern B 34 formed by both-end nozzles (PM and B) of the six colors at the right side, an adjustment pattern C 35 for detecting a deviation amount between the left side and the right side, in which, for example, MBk and PM are used as nozzles for recording this pattern, and a check pattern 36 for checking sure execution of deviation amount adjustment, recorded by nozzles (Y and B) of both ends of the carriage where a deviation amount is largest. The adjustment patterns are recorded by scanning only in one of a forward direction and a backward direction, whereby a recording position deviation amount caused by a change in head-to-paper distance can be removed. For example, when a head-to-paper distance is changed by a fixed amount such as rising of a platen position or a change in paper thickness, the change amount is only added to the correction amount of the discharge timing.

Thus, shortening of an adjustment period of time and a reduction in memory capacity can be realized by calculating recording position deviation amounts of 12 colors from the recording position deviation amounts of three colors. Concerning a method for storing the acquired adjustment values, a difference between an average adjustment value in the scanning direction and an adjustment value of each position is stored in a memory. Thus, the number of times of acquiring adjustment values in all the areas in the scanning direction can be reduced. The recording position adjustment of the orientation change of the carriage can be updated when the head is changed.

Figure 19:
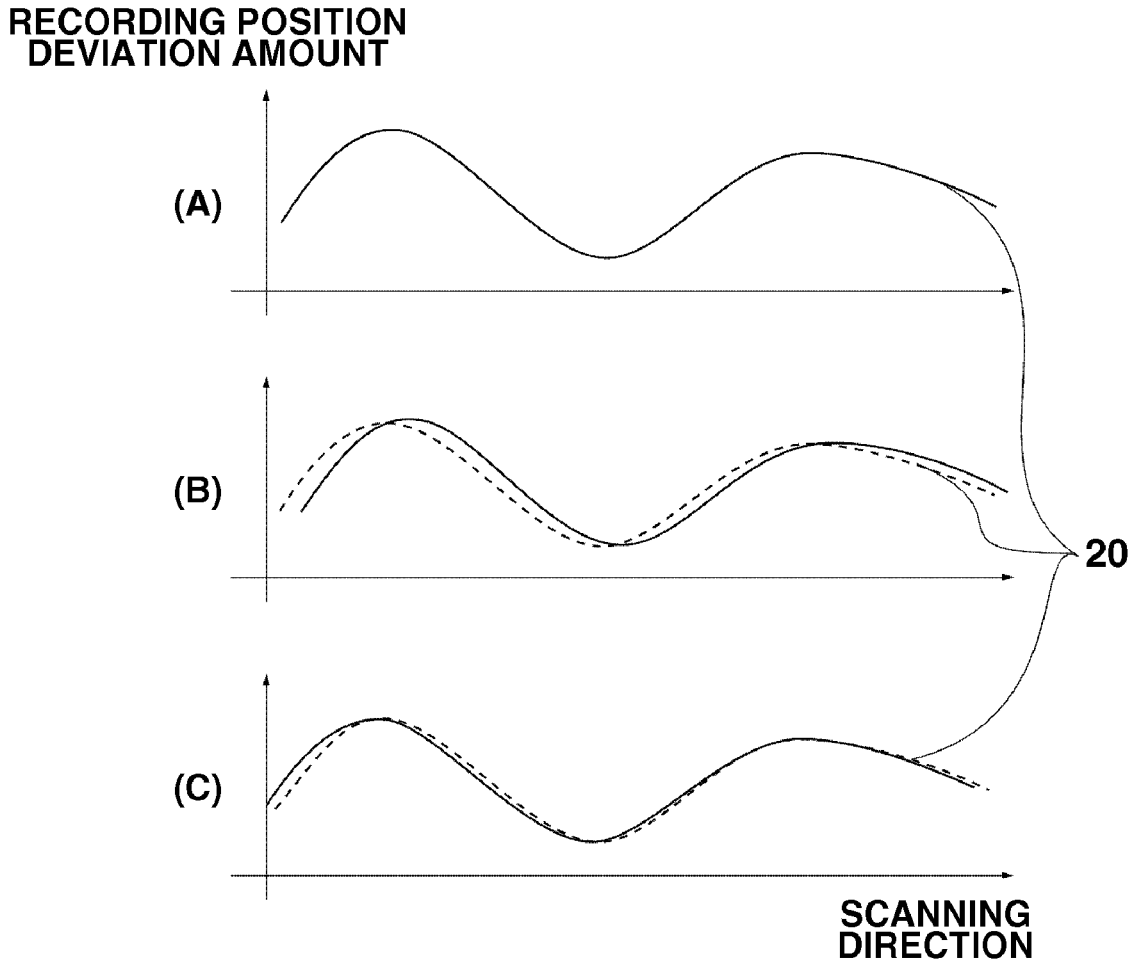
FIG. 19 illustrates recording position deviation amounts when a recording position shift amount is changed.
Figure 20A:
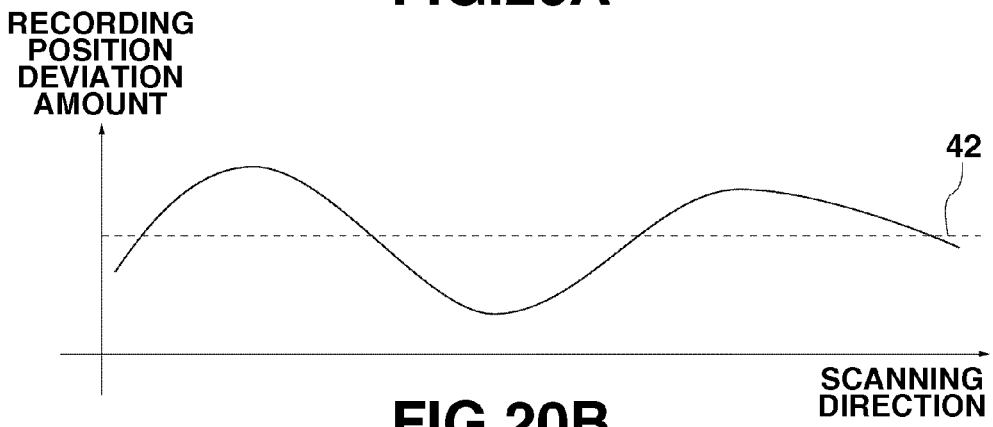
FIGS. 20A to 20C illustrate a conventional recording position adjustment method.
Figure 20B:
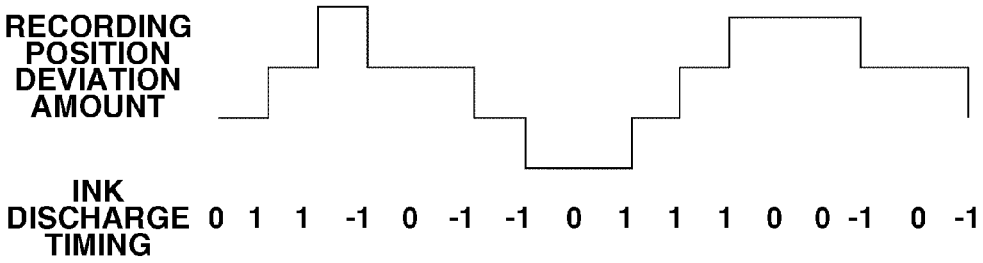
Figure 20C:
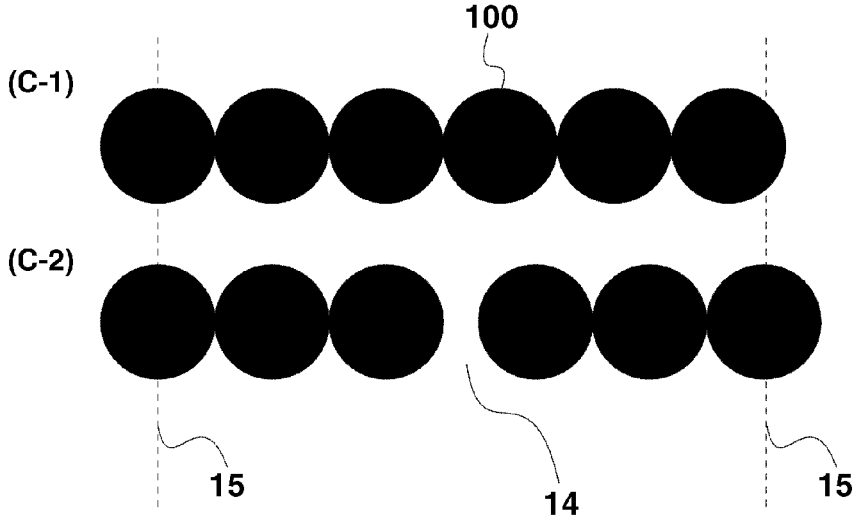

In the above description, the recording position shift amount is changed for each raster. However, a position of changing the recording position shift amount may be changed. FIG. 19 illustrates relationships at the first to third passes A to C between a position in the scanning direction and a recording position deviation amount when a position of changing the recording position shift amount is changed for each raster. At the first pass A in FIG. 19, a recording position shift amount (discharge timing) is calculated from original data indicating a recording position deviation amount. At the second pass B in FIG. 19, a position of changing the recording position shift amount is changed by changing a phase of an original recording position deviation amount and generating a recording position shift amount (discharge timing) from the changed recording position deviation amount. At the third pass C in FIG. 19, similarly, the phase of the original recording position deviation amount is changed to be different from that of the second pass, and a recording position shift amount (discharge timing) is generated from the changed recording position deviation amount. Thus, as in the case according to the present exemplary embodiment, deterioration of image quality caused by streaks can be reduced. This arrangement may be combined with the above-described exemplary embodiment.

In the above description, the recording position shift amount or the position of changing the shift amount is different from one raster to another. However, the shift amount or the position of changing the shift amount may be different for every predetermined number of rasters. In the case of performing recording with a plurality of nozzle arrays, even when the recording position shift amount or the position of changing the shaft amount is changed between the nozzle arrays, any generated streaks can be prevented or reduced from being visible.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-067908 filed Mar. 19, 2009, which is hereby incorporated by reference herein in its entirety.

What is claimed is:

1. A recording apparatus for recording an image on a recording medium comprising:

a recording head having a nozzle array formed by arranging a plurality of nozzles each configured to discharge ink;

a scanning unit configured to cause the recording head to perform scanning in a scanning direction intersecting with an arranging direction of the plurality of nozzles, the scanning unit causes the recording head to scan a same area of a recording medium a plurality of times to record an image;

an acquisition unit configured to acquire a plurality of gaps each being a distance between a target recording position and a recording position at each of positions, the positions being arranged in the scanning direction; and a driving control unit configured to obtain a plurality of correction amounts each for each of a plurality of scannings performed for recording the same area by changing phases of the plurality of gaps in the scanning direction and individually determine, based on the plurality of correction amounts, a driving timing of the recording head at each of the positions for each of the plurality of scannings.

2. The recording apparatus according to claim 1, wherein the acquisition unit acquires the plurality of gaps based on a pattern recorded on the recording medium.

3. The recording apparatus according to claim 1, wherein the acquisition unit acquires the plurality of gaps based on a distance between the recording head and the recording medium.

4. The recording apparatus according to claim 1, wherein the plurality of correction amounts differ with every scanning of the recording head.

5. The recording apparatus according to claim 1, wherein the recording head includes a plurality of nozzle arrays; and wherein the plurality of correction amounts differ with every nozzle array.

* * * * *